United States Patent [19]

True, Jr.

[11] 4,059,966

[45] Nov. 29, 1977

[54] AIRFLOW DISTRIBUTION ARRANGEMENT FOR A SIDE-BY-SIDE REFRIGERATOR

[75] Inventor: Howard D. F. True, Jr., Fern Creek, Ky.

[73] Assignee: General Electric Company, Louisville, Ky.

[21] Appl. No.: 708,431

[22] Filed: July 26, 1976

[51] Int. Cl.[2] ..... F25D 17/06

[52] U.S. Cl. ..... 62/414; 62/441; 98/39

[58] Field of Search ..... 62/414, 426, 441, 444, 62/419, 413; 219/367, 400; 165/124; 98/39; 415/209

[56] References Cited

U.S. PATENT DOCUMENTS

| | | | |
|---|---|---|---|
| 2,583,374 | 1/1952 | Hoffman | 98/43 PS |
| 3,403,533 | 10/1968 | Bollenbacher | 62/419 |
| 3,590,596 | 7/1971 | Johnson | 62/419 |
| 3,648,591 | 3/1972 | Winnett | 98/39 |
| 3,793,847 | 2/1974 | Scarlett et al. | 62/419 |
| 3,834,177 | 9/1974 | Scarlett | 62/444 |
| 3,893,307 | 7/1975 | Jacobs | 62/441 |

*Primary Examiner*—William E. Wayner
*Assistant Examiner*—R. J. Charvat
*Attorney, Agent, or Firm*—Steven C. Schnedler; Francis H. Boos

[57] ABSTRACT

An airflow distribution arrangement in a side-by-side refrigerator includes a cover which is located in the freezer compartment and which has an inner surface against which cool evaporator airflow is directed. A portion of the airflow travels down the inner surface of the cover to emerge through openings in the bottom of the cover into the freezer compartment. Additionally, the inner surface of the cover forms a part of a lateral duct in communication with the fresh food compartment. In order to force a sufficient quantity of cool evaporator airflow through the lateral duct into the fresh food compartment, a horizontally-extending, inward bulge is formed in the cover and located generally between the region on the inner surface of the cover against which airflow is directed and the bottom of the cover. The inward bulge serves to interrupt the otherwise smooth downward flow of air to produce an air eddy which in turn produces back pressure.

2 Claims, 4 Drawing Figures

AIRFLOW DISTRIBUTION ARRANGEMENT FOR A SIDE-BY-SIDE REFRIGERATOR

BACKGROUND OF THE INVENTION

1. Field Of The Invention

The present invention relates generally to side-by-side refrigerators and more particularly to an improved airflow distribution arrangement for such refrigerators.

2. Description Of The Prior Art

Household refrigerators of the type having a side-by-side configuration generally include a vertically-extending freezer compartment on the left side, a vertically-extending fresh food compartment on the right side, and a vertical insulating partition separating the two compartments. In order to cool such a refrigerator, a refrigeration evaporator is included within an evaporator air channel extending vertically along the rear wall of the freezer compartment and having an air outlet near the top for expelling cool evaporator air. A fan is included to circulate air through the air channel and over the evaporator. An airflow distribution arrangement located near the top of the evaporator air channel generally includes means for directing a major portion of the cool evaporator air into the freezer compartment and for directing a minor portion of the cool evaporator air laterally through an opening in the vertical partition into the fresh food compartment. In one particular arrangement, the means for directing airflow includes a housing or cover spaced forwardly of the evaporator air channel outlet and defining a chamber into which the cool evaporator airflow is directed and further defining a portion of a duct in communication with the fresh food compartment. Airflow from the evaporator air channel outlet is directed generally forwardly against the inner surface of the cover. The air then tends to travel generally downwardly along the inner surface of the cover to pass out through openings in the bottom of the cover into the freezer compartment.

In order to impede this downward flow of air and to force a sufficient amount of cool evaporator airflow laterally through the passageway in the partition, separate baffle members are attached generally to the evaporator air channel cover at a location below the fan.

While such prior art arrangements are generally effective for properly directing airflow laterally into the fresh food compartment, the use of separate baffle members increases the total number of parts required in a refrigerator with an attendant increase in cost.

SUMMARY OF THE INVENTION

It is a primary object of the invention to provide an airflow distribution arrangement for a side-by-side refrigerator which effectively directs a sufficient amount of cool evaporator airflow into the fresh food compartment and which at the same time is simple and economical of construction.

It is another object of the invention to eliminate the need for separate baffle members in such an airflow-directing arrangement with no sacrifice in performance.

These and other objects are accomplished by the invention in which the cover spaced forwardly of the evaporator air channel outlet includes a horizontally-extending, inward bulge located generally between the region on the inner surface of the cover against which cool evaporator airflow is directed and the bottom of the cover. The bulge serves to interrupt the otherwise smooth downward flow of air over the cover inner surface to produce an airflow eddy at the upper part of the inward bulge. As a result, back pressure is produced and a portion of the cool evaporator airflow is directed laterally through the duct formed by the cover and through the partition passageway into the fresh food compartment.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DESCRIPTION OF THE PREFERRED EMBODIMENT

Figure 1:
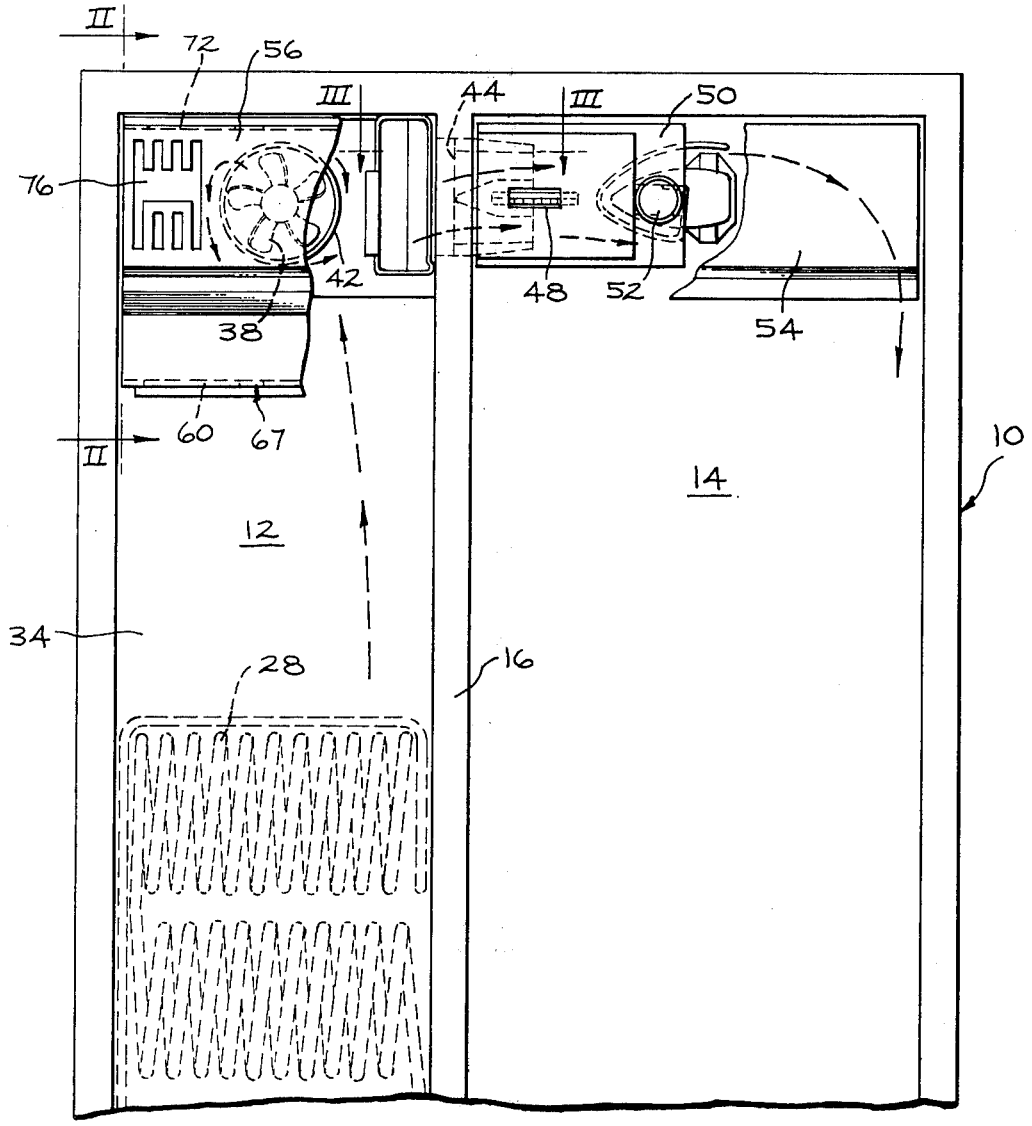
FIG. 1 is a front elevational view of the upper part of a side-by-side refrigerator embodying the invention, the front door and shelves being removed and certain parts partially broken away for convenience of illustration.
Figure 2:
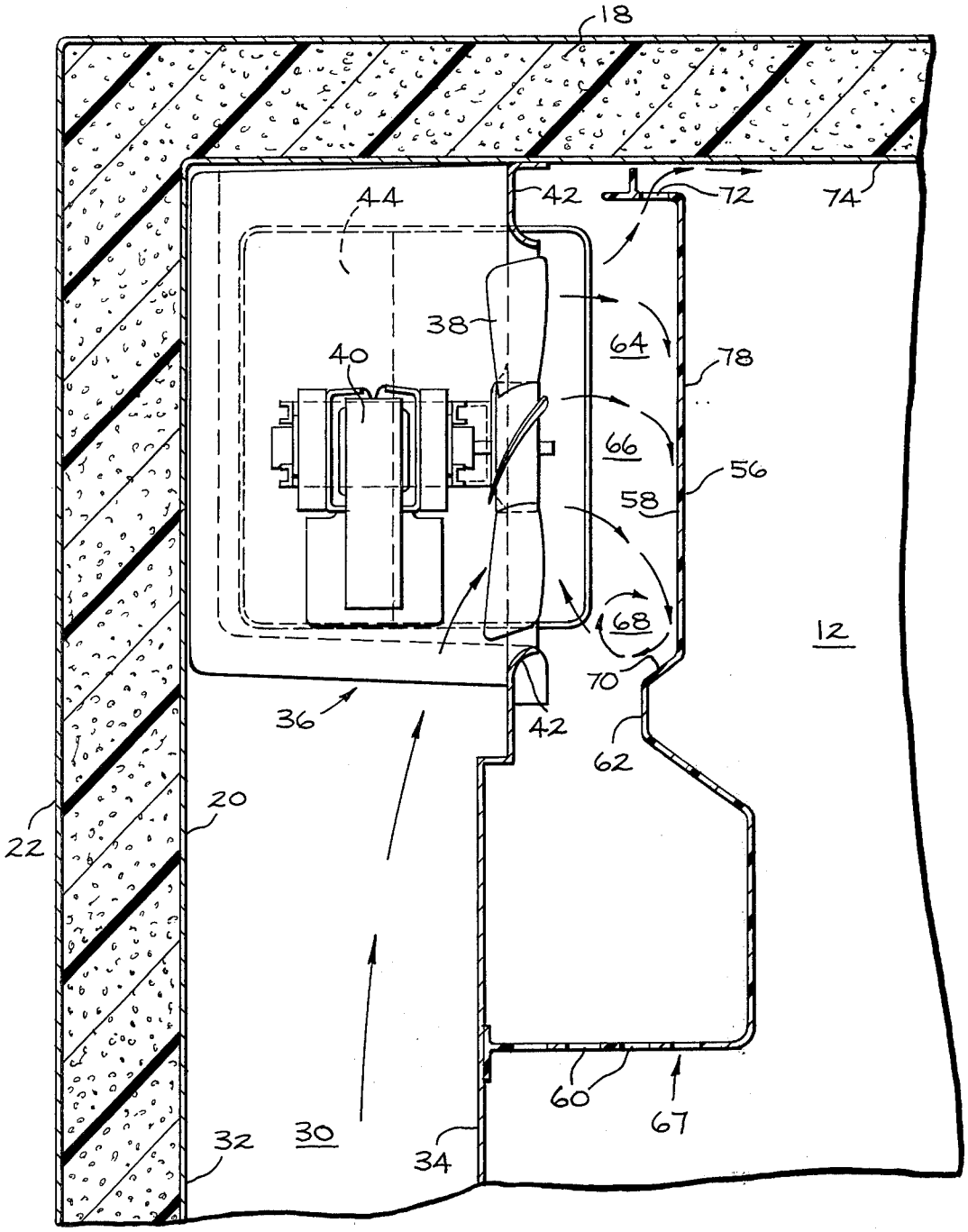
FIG. 2 is an enlarged sectional side view taken generally along line II—II of FIG. 1.
Figure 3:
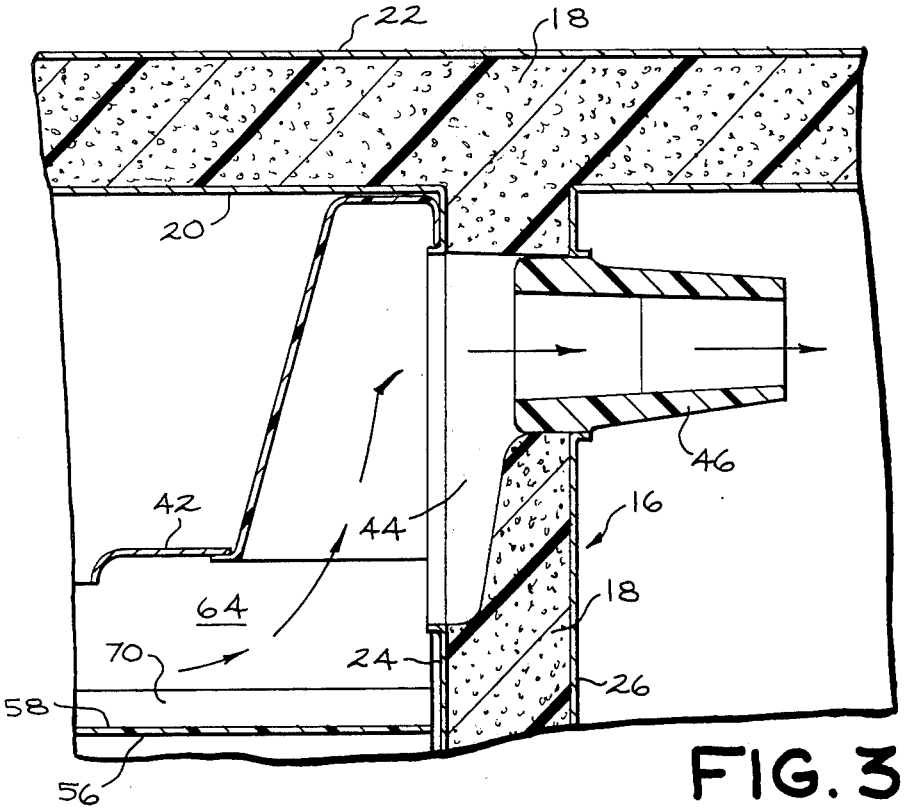
FIG. 3 is an enlarged sectional downward view taken generally along line III—III of FIG. 1.
Figure 4:
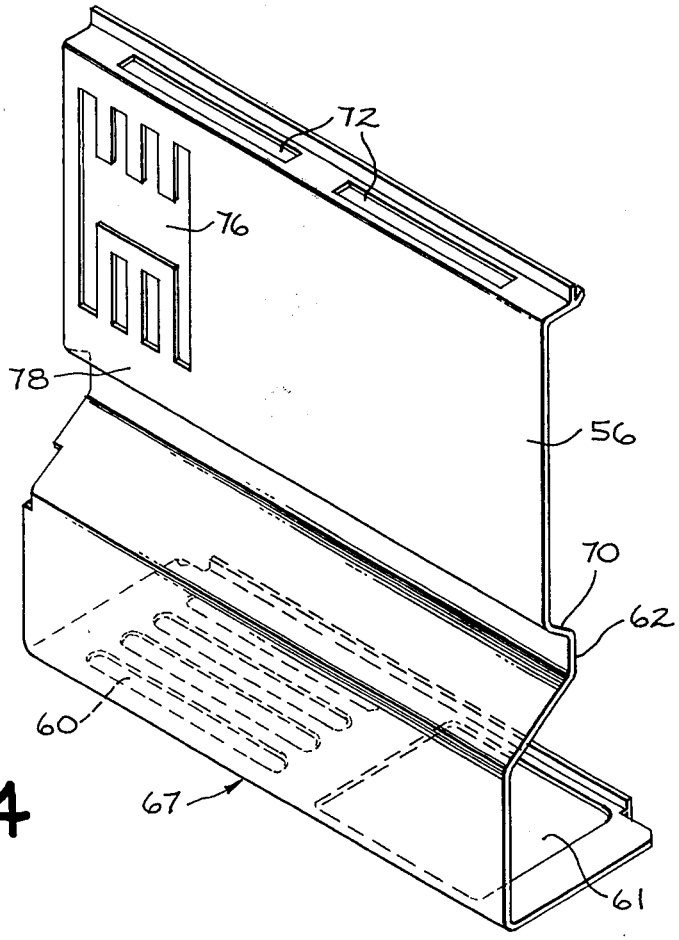
FIG. 4 is a perspective view of the cover portion of the present invention shown removed from the refrigerator.

Referring now to the drawings wherein like reference numerals designate similar or corresponding parts shown in the various views, a side-by-side refrigerator 10 includes a freezing compartment 12 and a fresh food compartment 14 separated by a vertical partition 16. Thermal insulation material 18 fills both the space between the inner liner 20 and the outer case 22 and the space between the left and right walls 24 and 26 of the partition 16.

The refrigerator 10 includes a cooling evaporator 28 connected in a conventional closed refrigerant circuit refrigeration system. The evaporator 28 is disposed within an evaporator air channel 30 defined by the rear portion 32 of the inner liner 20 and an evaporator air channel cover 34. The evaporator air channel 30 extends generally vertically along the rear wall 32 of the freezer compartment 12 and has an air outlet, generally designated at 36, near the top thereof. In order to cool the compartments 12 and 14, a means in the form of a fan 38 driven by an electric motor 40 is included for forcing circulation of air over the evaporator 28 and through the air channel 30. The fan 38 is positioned within a shroud 42 which forms a part of the evaporator air channel outlet 36 to direct cool evaporator air generally forward. While the illustrated fan 38 is located at the top of the evaporator air channel 30 and draws air through the evaporator 28, it will be apparent that the fan 38 itself may be disposed in any convenient location to force airflow through the evaporator air channel 30. In any event, the evaporator air channel outlet will still be near the top.

An airflow distribution arrangement, hereinafter described in greater detail, apportions the cool evaporator air passing through the air outlet 36 between major and minor airstreams. The major airstream flows generally downwardly through the freezer compartment 12 to re-enter the evaporator air channel 30 through an inlet (not shown) located below the evaporator 28, and the minor airstream passes through a passageway 44 in the partition 16 into the top of the fresh food compartment 14. This minor airstream passes generally downwardly through the fresh food compartment 14 and back through another partition passageway (not shown) to re-enter the lower portion of the evaporator air channel 30 below the evaporator 28.

In order to control the temperatures in the compartments 12 and 14, the airflow into the fresh food compartment 14 also passes through a damper housing 46 including an air damper (not shown) operatively connected to a freezer temperature control wheel 48 and past a thermostatic sensing element 50 operatively associated with a fresh food temperature control knob 52. The above-mentioned temperature controlling elements may be conventional and are generally located near the top of the fresh food compartment 14 and concealed by a housing 54, which also serves to channel the airflow.

Within the upper part of the freezer compartment 12, the airflow distribution arrangement includes a cover 56 spaced forwardly of the evaporator air channel outlet 36 such that cool evaporator air is directed towards and tends to travel down the inner surface 58 of the cover 56 to emerge through bottom openings 60 and 61 into the freezer compartment 12. Additionally, the cover 56, together with a portion of the fan shroud 42, defines a lateral duct 64 communicating with the partition passageway 44.

In accordance with the present invention, a horizontally-extending inward bulge 62 is formed in the cover 56 at a location generally between the region 66 on the inner surface 58 of the cover 56 against which cool evaporator airflow is directed and the cover bottom 67. The bulge 62 serves to interrupt the otherwise smooth downward flow of air over the inner surface 58 to produce an air eddy, depicted at 68, and to produce back pressure to force a portion of the cool evaporator airflow laterally to the right generally along the upper part 70 of the bulge 62 through the lateral duct 64 and the passageway 44 into the fresh food compartment 14.

In addition to the bottom openings 60 and 61, the cover 56 includes slotted openings 72 in the top thereof for directing a portion of the cool evaporator airflow generally along the top wall 74 of the freezer compartment 12 and forwardly towards the inner surface of the freezer door (not shown). This airflow tends to flow downwardly along the inner door surface to provide cooling in that general region of the freezer compartment 12. It will be apparent that the back pressure produced by the interruption of downward airflow by the inward bulge 62 aids in forcing airflow through the openings 72.

There is an additional opening 76 on the left side of the front face 78 of the cover 56 to direct cool evaporator airflow over automatic ice-making means (not shown) which may be included in the freezing compartment 12. The irregular shape of the illustrated opening 76 serves to block the passage of human fingers which conceivably might otherwise engage the rotating fan 38, and yet permits the passage of an ice-maker water supply line therethrough. In the event the refrigerator 10 is not equipped with an automatic ice maker, the opening 76 may be fitted with a removable cover (not shown). Since the opening 76 is disposed in communication with the lateral duct 64 and positioned generally above the inward bulge 62, an increased amount of airflow will be directed therethrough.

In the operation of the refrigerator 10 including the present invention, the fan 38 circulates air over the evaporator 28 and through the evaporator air channel 40 and out the opening 36 defined generally by the top of the air channel 30 and the fan shroud 42 so that the air is directed against the inner surface 58 of the cover 56. Airflow tends to travel smoothly down the inner surface 58 until interrupted by the inward step of bulge 62 which breaks up the airflow to create the eddy 68 and to produce a region of slightly higher pressure above the bulge 62. This tends to force airflow along the bulge upper part 70 and through the passageway 44 into the fresh food compartment 14, and, additionally, through the openings 72 and the top of the cover 56, and through the ice-maker air opening 78, if uncovered.

It will be apparent, therefore, that the present invention provides an improved airflow-directing arrangement for a side-by-side refrigerator which functions effectively to distribute the proper proportions of cool evaporator airflow between the freezer and fresh food compartments and which does not require separate air-directing baffles at additional cost to accomplish this result.

While a specific embodiment of the invention has been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. In a side-by-side refrigerator of the type including a freezer compartment, a fresh food compartment, a vertical partition separating the compartments, an evaporator air channel extending vertically along the rear wall of the freezer compartment and having an air outlet near the top for directing cool evaporator air generally forward, means for forcing circulation of air through the evaporator air channel and out the air outlet near the top, and a passageway in the partition for passing cool evaporator air into the fresh food compartment, an airflow distribution arrangement comprising:

a cover spaced forwardly of the evaporator air channel outlet such that cool evaporator air is directed towards and tends to travel down the inner surface of said cover, said cover having a bottom opening for discharging cool evaporator air into the freezer compartment, and said cover defining a lateral duct communicating with the passageway in the partition; and a horizontally-extending inward bulge formed in said cover and located generally between the region on the inner surface of said cover against which cool evaporator airflow is directed and the cover bottom, said bulge serving to interrupt the otherwise smooth downward flow of air to produce back pressure to force a portion of the cool evaporator airflow through the partition passageway into the fresh food compartment.

2. Apparatus according to claim 1, wherein said cover includes an opening in the front wall thereof located above said inward bulge for directing cool evaporator airflow over ice-making means which may optionally be included in the freezer compartment.

* * * * *